US007040781B2

(12) United States Patent
Kosters et al.

(10) Patent No.: US 7,040,781 B2
(45) Date of Patent: May 9, 2006

(54) LUMINAIRE

(75) Inventors: Paulus Gerardus Henricus Kosters, Winterswijk (NL); Petrus Adrianus Josephus Holten, Winterswijk (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 95 days.

(21) Appl. No.: 10/502,524

(22) PCT Filed: Jan. 27, 2003

(86) PCT No.: PCT/IB03/00243

§ 371 (c)(1),
(2), (4) Date: Jul. 26, 2004

(87) PCT Pub. No.: WO03/064918

PCT Pub. Date: Aug. 7, 2003

(65) Prior Publication Data

US 2005/0063190 A1 Mar. 24, 2005

(30) Foreign Application Priority Data

Jan. 28, 2002 (EP) ..... 02075372

(51) Int. Cl.
*F21V 11/02* (2006.01)

(52) U.S. Cl. ..... 362/291; 362/290

(58) Field of Classification Search ..... 362/290, 362/291, 364
See application file for complete search history.

(56) References Cited

U.S. PATENT DOCUMENTS

| | | | | |
|---|---|---|---|---|
| 5,570,947 | A * | 11/1996 | Felland | 362/148 |
| 5,758,954 | A * | 6/1998 | Holten et al. | 362/291 |
| 5,908,234 | A * | 6/1999 | Kreeft | 362/223 |
| 5,944,411 | A * | 8/1999 | Holten et al. | 362/342 |
| 6,220,729 | B1 * | 4/2001 | Holten | 362/291 |
| 6,582,099 | B1 * | 6/2003 | Bartenbach | 362/291 |

* cited by examiner

*Primary Examiner*—Ali Alavi
*Assistant Examiner*—Hargobind S. Sawhney

(57) ABSTRACT

The invention is related to a luminaire for housing a tubular lamp. According to the invention the luminaire has a housing with a light emission window, means for accommodating a tubular lamp in it along the window and in a plane P perpendicular to said window, side reflectores, and lamellae positioned between the reflectors and transverse to the emission window. The lamellae having an outer edge, which is diverging from an inner edge from the plane P towards points A and A' on either side of the plane P. From the point A, A' the outer edge extends towards the nearby side reflector enclosing at point A an angle with the emission window and directed towards the said side reflector.

11 Claims, 4 Drawing Sheets

LUMINAIRE

The invention relates to a luminaire.

Such a luminaire is disclosed, inter alia, in WO 96/25623. By virtue of the specific shape of the lamellae in this luminaire, a workplace can be efficiently lit without disturbing reflections of the lamp on, for example, display screens or otherwise undesirable spot luminances in the generated light beam. The shielding effect of the lamellae enables the height dimension of the luminaire to be held comparatively small, which is favorable for mounting said luminaire, for example in the case of a built-in luminaire. A drawback of the known luminaire resides in that the lamellae have comparatively large dimensions and a largest height at the location of longitudinal reflectors. The lamellae are made of metal, for example aluminum. The mounting of the lamellae in the longitudinal reflectors is time consuming. This too is a drawback.

It is an object of the invention to largely overcome said drawbacks, while maintaining the favorable properties of the luminaire.

To achieve this object, the luminaire in accordance with the invention which is intended for accommodating an electric lamp provided with a tubular envelope of diameter D is characterized in that said luminaire is equipped with:

- a housing with a light emission plane;
- one or more lamp holders for accommodating the electric lamp along the light emission plane and in a plane P transverse to the light emission window;
- reflector bodies arranged on either side of, and along, plane P, which reflector bodies are each concavely curved towards plane P and each have a lower edge situated in the light emission plane;
- a lamella transverse to the light emission plane and between both reflector bodies, which lamella has an outer edge facing the light emission plane and an inner edge, said outer edge, at the location of plane P, extending on either side of said plane P, so as to diverge from the inner edge, along the light emission plane to a point A, A', and further extending from point A, A' to the juxtaposed reflector body in a direction, at the location of point A, A', such that an angle $\alpha$ facing the relevant reflector body is made with the light emission plane.

The luminaire in accordance with the invention has the advantage that the size of the lamella can be much smaller than that of the known luminaire. As a result, it is attractive to use synthetic resin for the manufacture of the lamella and subsequently provide said lamella in known manner with a reflective, possibly also specular layer, for example a metal layer. By using synthetic resin for the lamella it becomes advantageously possible to reliably manufacture a complete framework of lamellae on an industrial scale, which framework is attached as a single element in or to the reflector bodies arranged opposite each other on either side of the plane P. Frequently the opposite reflector bodies are each provided with an upper edge which are arranged some distance apart. In such luminaires, lamellae, preferably in a framework of lamellae, in accordance with the invention can be advantageously used, said lamellae being provided at the end portions with fastening strips extending from the inner edge to beyond the outer edge of the relevant lamella and hence forming projecting parts of the fastening strips. Said projecting parts thus can reach over the upper edge of the reflector bodies so as to engage said reflector bodies. By virtue thereof, on the one hand, the lamellae can be mounted in a very simple and hence advantageous manner in the luminaire, and, on the other hand, the fastening strips can be used to fulfill part of the reflection function of the reflector bodies. In this manner, a further improvement of the optical properties of the luminaire is made possible in an advantageous way. This also enables a further optimization of the manufacturing process. A further advantage is that construction details can thus be effectively hidden from view.

Preferably, the outer edge of the lamella between the points A, A' is concavely curved in the direction of the light emission plane. The degree to which the outer edge extending between the points A and A' is concavely curved is determined by the shielding effect to be realized on light rays in different planes perpendicular to plane P, the so-termed C-planes, in a manner as set forth in WO 96/25623. In this manner, a further optimization of the dimensions of the lamellae is obtained.

In a further preferred embodiment, the enclosed angle $\alpha$ is an acute angle. This helps, in particular, to realize a shape of the lamellae such that they can be manufactured using a self-releasing mold.

The advantage of smaller dimensions is enhanced in a preferred embodiment in that the outer edge of the lamella is situated at a distance from the light emission plane. A further improvement is obtained if point A or A' lies within a distance equal to the lamp diameter D from a connection line through the lower edge of the juxtaposed reflector body to a part of the electric lamp's tubular envelope facing the light emission plane at the location of plane P. In this manner, a practicable dimension is obtained of the part of the outer edge which extends on either side of the plane P so as to diverge from the inner edge, so that the emission of direct radiation from the light emission plane at unpermitted angles is precluded, i.e. at such angles that for attaining a desirable luminance distribution the risk occurs of undesirable direct radiation or of the formation of reflections considered impermissible at objects on or near the workplace.

To preclude undesirable reflections, the lamella is provided in an advantageous embodiment with a reflection surface between outer edge and inner edge, which reflection surface has a radius of curvature in a section parallel to plane P. Preferably the radius of curvature has a center point situated at a distance from the light emission plane that is smaller than the distance between the outer edge and the light emission plane in the relevant section parallel to plane P. The prevention of undesirable reflections is further improved in that preferably point A, A' is connected to, respectively, point B, B' on the inner edge in such a manner that the reflection surface situated between the points A, A', B, B' forms a center part that is bounded by side portions for which it holds that, considered in a plane parallel to plane P, a radius of curvature rm at the location of the center part is smaller than a radius of curvature rz at the location of each of the side portions.

This goal is achieved to a higher degree in that preferably the points A, B and A', B' are at a distance from each other that is larger than a distance from a point on the outer edge to the inner edge as well as from a point on the inner edge to the outer edge for the relevant sections of the outer edge and the inner edge that are situated on the same side of plane P as the points A, B and A', B'. This has the further advantage that the dimensions of the side portions of the lamella at the location of the reflector bodies can only be small, as a result of which the reflector bodies contribute more effectively to a uniform luminance distribution at the light emission plane and a reduction of contrast within this light distribution will occur.

An embodiment of a luminaire in accordance with the invention will be explained in greater detail hereinbelow with reference to the drawing.

Figure 1:
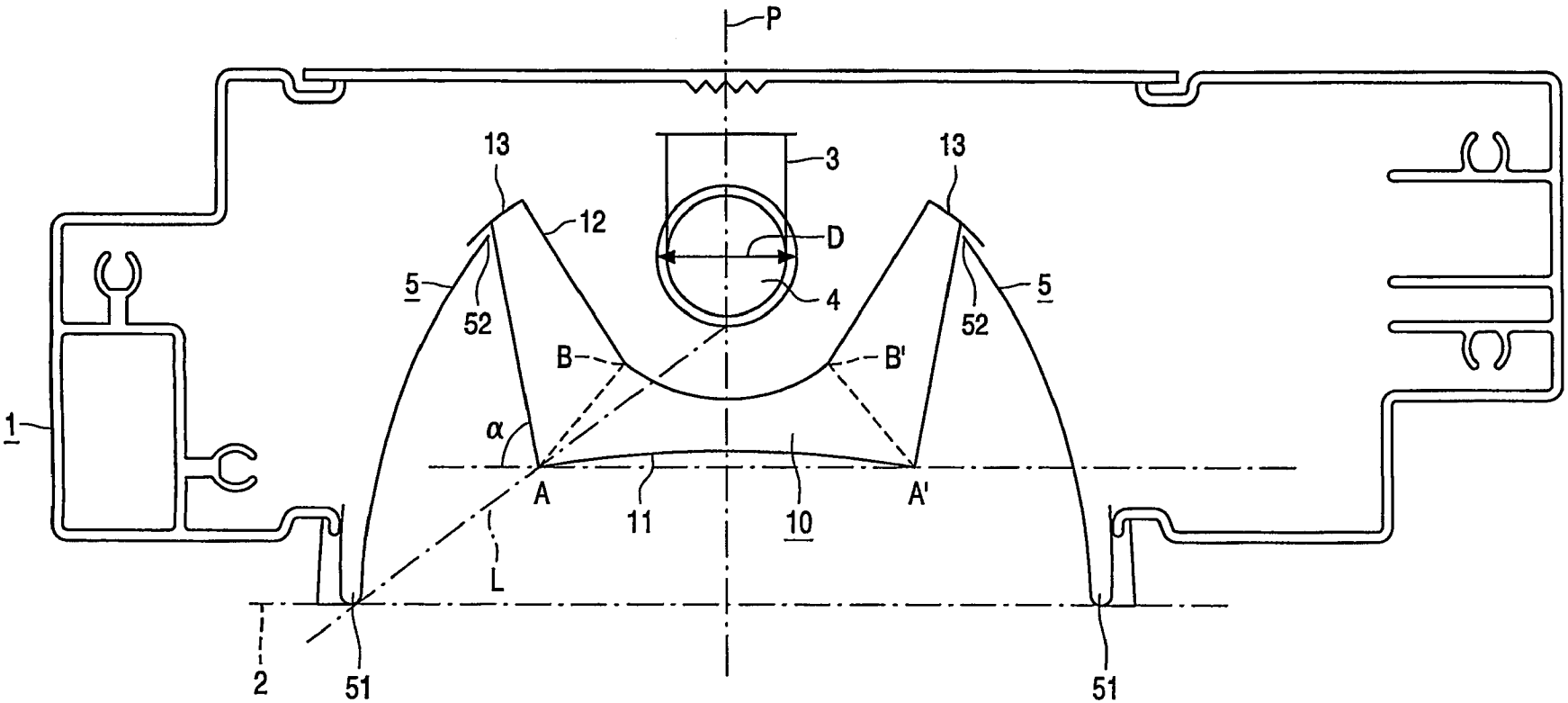
FIG. 1 is a cross-sectional view of the luminaire.
Figure 2:
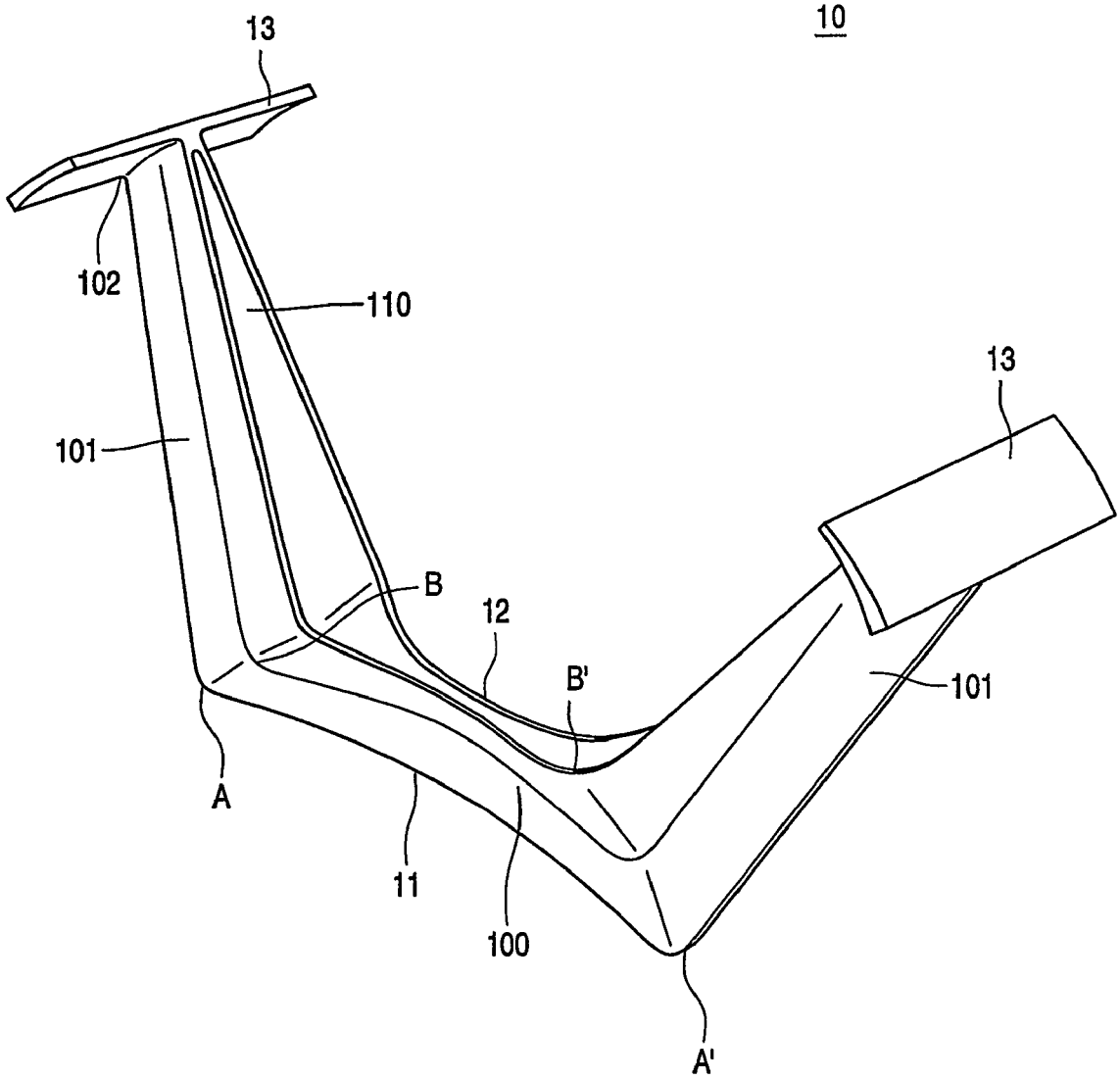
FIG. 2 is a perspective view of a lamella of the luminaire.

The luminaire shown in FIG. 1 is intended for accommodating an electric lamp provided with a tubular envelope 4 of diameter D, and is equipped with:

a housing 1 with a light emission plane 2;

one or more lamp holders 3 for accommodating the electric lamp along the light emission plane and in a plane P transverse to the light emission window;

reflector bodies 5 arranged on either side of, and along, plane P, which reflector bodies are each concavely curved towards plane P and are each provided with a lower edge 51 situated in the light emission plane and with an upper edge 52 which are spaced some distance apart;

a lamella 10 transverse to the light emission plane and between both reflector bodies, which lamella has an outer edge 11 facing the light emission plane and an inner edge 12, said outer edge, at the location of plane P, extending on either side of said plane P, so as to diverge from the inner edge 12, along the light emission plane to a point A, A', and further extending from point A, A' to the juxtaposed reflector body in a direction, at the location of point A, A', such that an angle α facing the relevant juxtaposed reflector body is made with the light emission plane. The outer edge 11 of the lamella is situated at a distance from the light emission plane 2. In the example described herein, the outer edge between the points A, A' is concavely curved in the direction of the light emission plane. In the case shown, the outer edge extends from the point A, A' to the relevant juxtaposed reflector body at an angle α smaller than 90°. Angle α thus is an acute angle.

In the case shown, point A is situated on a connection line L through the lower edge 51 of the juxtaposed reflector body 5 to a part of the electric lamp's tubular envelope 4 facing the light emission plane at the location of plane P. Point A' is correspondingly situated. Point A may be situated, in an alternative embodiment, at a distance from the connection line L, which distance is smaller than the size of the lamp diameter D. Between outer edge 11 and inner edge 12, the lamella has a reflection surface which, in a section parallel to plane P, has a radius of curvature. Preferably the radius of curvature has a center point at a distance from the light emission plane that is smaller than the distance between the outer edge and the light emission plane in the relevant section parallel to plane P.

Figure 3:
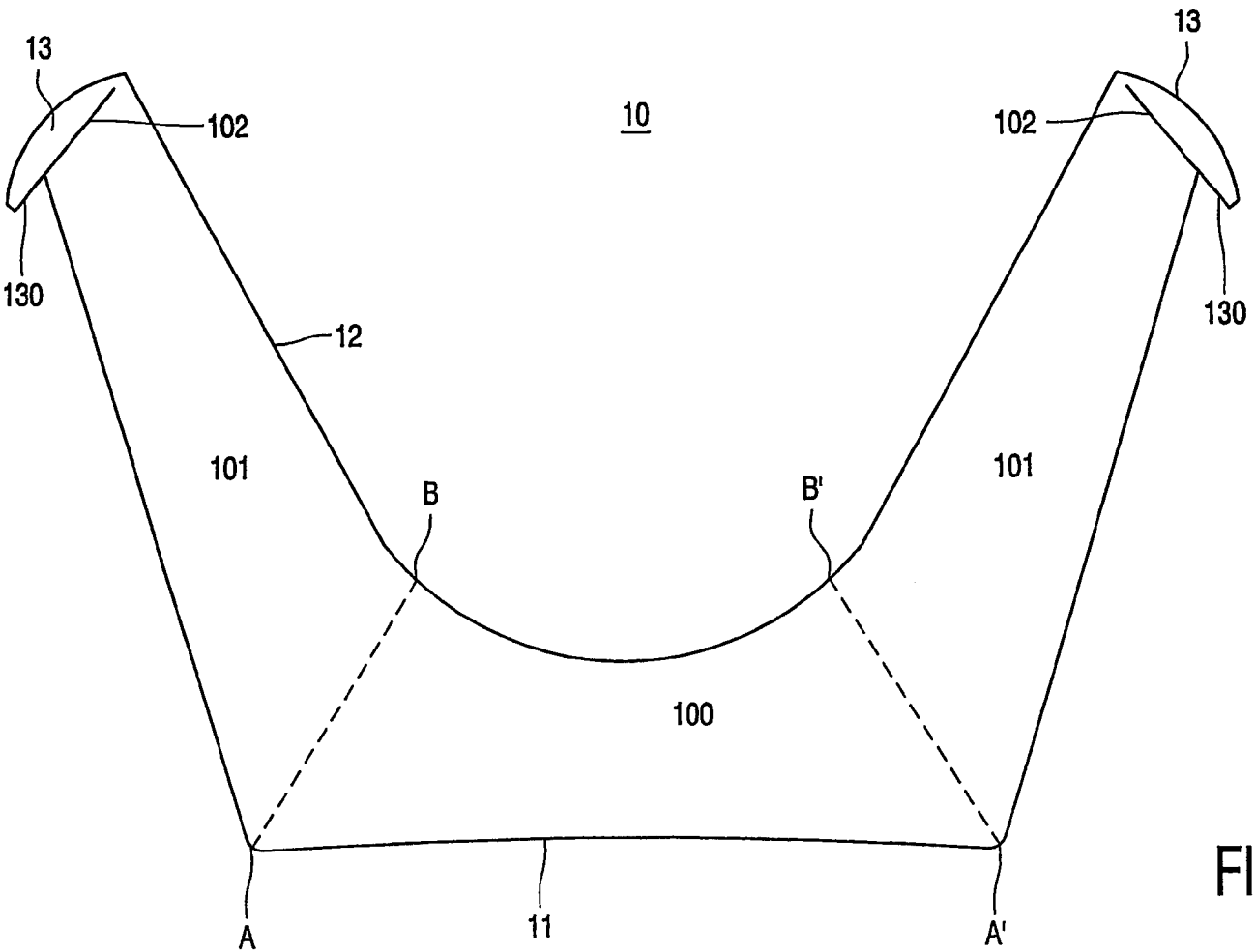
FIG. 3 is a side view of the lamella.

The lamella is depicted in detail in the side view shown in FIG. 3. In the lamella, point A and A' are connected to, respectively, point B and B' on the inner edge 12 in such a manner that the reflection surface situated between the points A, A', B, B' forms a center part 100 that is bounded by side parts 101 for which it holds that, considered in a plane parallel to plane P, a radius of curvature rm at the location of the center part is smaller than a radius of curvature rz at the location of each of the side parts. In addition, the distance between the points A and B and between the points A' and B' is larger than a distance from a point on the outer edge 11 to the inner edge 12 as well as from a point on the inner edge 12 to the outer edge 11 for relevant sections of the outer edge and the inner edge which are situated on the same side of plane P as the points A, B and A', B'.

At end portions 102, the lamella 10 is provided with fastening strips 13 extending from the inner edge 12 to beyond the outer edge 11 of the lamella, thereby forming projecting parts 130. Said projecting parts 130 reach over the upper edge 52 of the reflector bodies so as to engage said reflector bodies. To fix the mutual position of the reflector body and the lamella or framework of lamellae, use can be made of a lock, for example in the form of a snap connection. To simplify the operations necessary to replace a lamp, it is preferably possible to undo this lock.

The lamella is made of synthetic resin, for example polycarbonate. Lamellae and frameworks of lamellae can be very advantageously manufactured in accordance with the invention by means of injection molding. The shape of the lamella shown as well as the shape of a framework of such lamellae is such that they can very suitably be manufactured by means of a self-releasing mold. For this purpose, the enclosed angle α is an acute angle which in practice does not exceed 88.5°.

Preferably the lamella forms part of a framework of lamellae formed as a single element, the length of which is equal to that of the luminaire or such that the length of the luminaire is an integral multiple thereof. In a favorable embodiment, the lamellae are equidistantly arranged in the framework.

Figure 4:
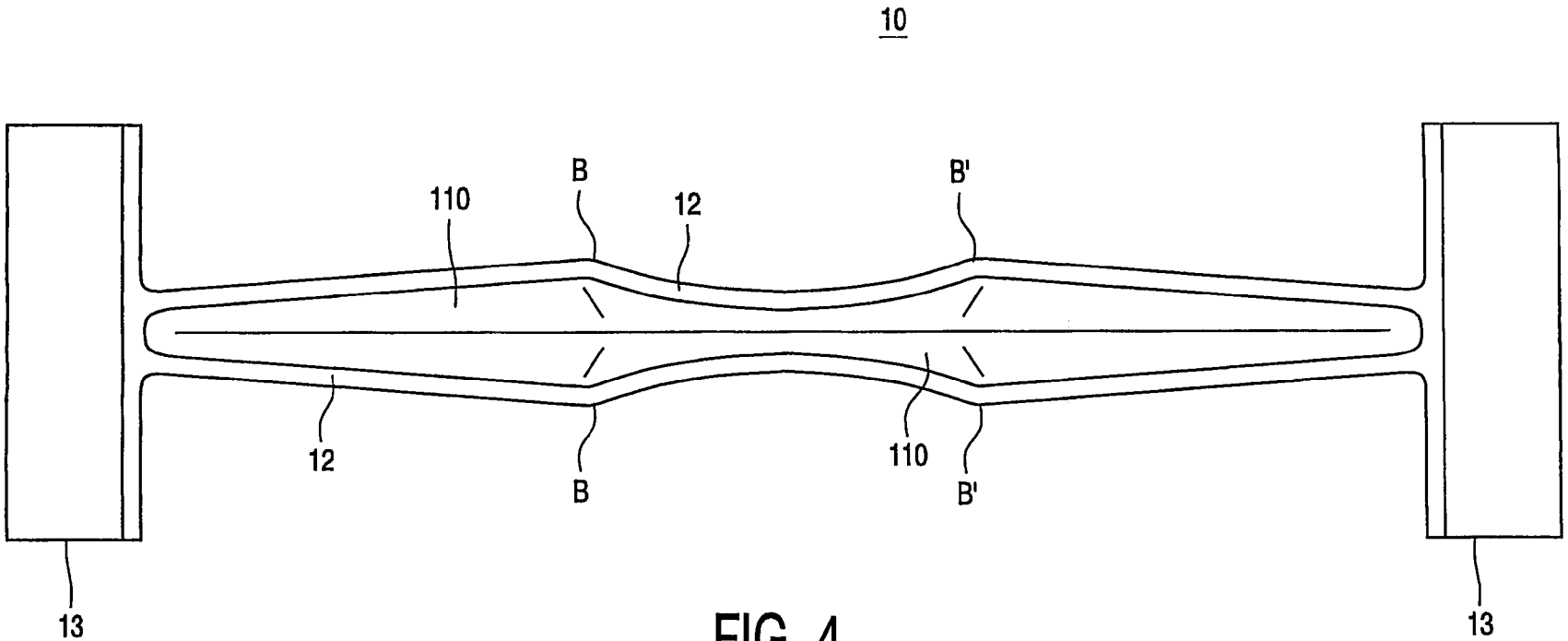
FIG. 4 is a plan view of the lamella.

It has been found that highly uniform illumination can be very advantageously obtained by means of the luminaire by providing each lamella with two reflection surfaces that are similar in form, the curvatures of said reflection surfaces, considered in a plane parallel to plane P, concavely facing away from each other. This is visible in the plan view shown in FIG. 4. In the case of the lamella shown, inner sides 110 of the reflection surfaces form a hollow space which is open at the upper edge. To improve the light output of the luminaire, the inner sides may be covered with a reflective, if necessary partly specular, layer. On the other hand, the output can also be improved by using a solid lamella the inner edge 12 of which is provided with a reflective coating.

In a practical embodiment of the luminaire the acute angle α is approximately 60°. The inner edge of the lamella makes an angle β with the plane P, which angle varies between 90° at the location of plane P and approximately 30°.

The invention claimed is:

1. A luminaire which is intended for accommodating an electric lamp provided with a tubular envelope of diameter D, characterized in that said luminaire is equipped with:

a housing with a light emission plane;

one or more lamp holders for accommodating the electric lamp along the light emission plane and in a plane P transverse to the light emission window;

reflector bodies arranged on either side of, and along, plane P, which reflector bodies are both concavely curved towards plane P and each have a lower edge situated in the light emission plane;

a lamella transverse to the light emission plane and between both reflector bodies, which lamella has an outer edge facing the light emission plane and an inner edge, said outer edge, at the location of plane P, extending on either side of said plane P, so as to diverge from the inner edge, along the light emission plane to a point A, A', and further extending from point A, A' to the juxtaposed reflector body in a direction, at the location of point A, A', such that an angle α facing the relevant reflector body is made with the light emission plane.

2. A luminaire as claimed in claim 1, characterized in that the outer edge between the points A, A' is concavely curved in the direction of the light emission plane.

3. A luminaire as claimed in claim 1, characterized in that the enclosed angle α is an acute angle.

4. A luminaire as claimed in claim 1, characterized in that the outer edge of the lamella is situated at a distance from the light emission plane.

5. A luminaire as claimed in claim 4, characterized in that point A, A' is connected to, respectively, point B, B' on the inner edge in such a manner that the reflection surface situated between the points A, A', B, B' forms a center part that is bounded by side portions for which it holds that, considered in a plane parallel to plane P, a radius of curvature rm at the location of the center part is smaller than a radius of curvature rz at the location of each of the side portions.

6. A luminaire as claimed in claim 1, characterized in that point A or A' lies within a distance equal to the lamp diameter D from a connection line through the lower edge of the juxtaposed reflector body to a part of the electric lamp's tubular envelope facing the light emission plane at the location of plane P.

7. A luminaire as claimed in claim 6, characterized in that the points A, B and A', B' are at a distance from each other that is larger than a distance from a point on the outer edge to the inner edge as well as from a point on the inner edge to the outer edge for the relevant sections of the outer edge and the inner edge that are situated on the same side of plane P as the points A, B and A', B'.

8. A luminaire as claimed in claim 1, characterized in that between outer edge and inner edge the lamella has a reflection surface which, in a section parallel to plane P, has a radius of curvature.

9. A luminaire as claimed in claim 1, characterized in that the reflector bodies are each provided with an upper edge which are arranged at some distance from each other, and end portions of the lamella are provided with fastening strips each extending from the inner edge to beyond the outer edge of the relevant lamella.

10. A luminaire as claimed in claim 1, characterized in that the lamella is made from a synthetic resin coated with a reflective layer.

11. A luminaire as claimed in claim 1, characterized in that the lamella forms part of a framework of lamellae.

* * * * *